United States Patent [19]

Barrios

[11] Patent Number: 4,972,641

[45] Date of Patent: Nov. 27, 1990

[54] LEAVE-IN-PLACE CANTILEVER CONCRETE FOUNDATION FORM

[75] Inventor: Richard C. Barrios, Louisville, Ky.

[73] Assignee: Modern Industries, Inc., Louisville, Ky.

[21] Appl. No.: 413,840

[22] Filed: Sep. 27, 1989

[51] Int. Cl.[5] ..... E02D 27/00

[52] U.S. Cl. ..... 52/295; 52/296; 249/48

[58] Field of Search ..... 52/294, 295, 296, 126.6, 52/250, 258; 249/13, 42, 48, 34

[56] References Cited

U.S. PATENT DOCUMENTS

| | | | |
|---|---|---|---|
| 3,219,308 | 11/1965 | Halstead | 249/48 |
| 3,617,047 | 11/1971 | Holt | 249/48 |
| 3,945,601 | 3/1976 | Rowley | 249/48 |
| 4,434,600 | 3/1984 | Backman | 52/296 |
| 4,817,353 | 4/1989 | Woods et al. | 52/295 |

*Primary Examiner*—John E. Murtagh

*Attorney, Agent, or Firm*—D. A. N. Chase

[57] ABSTRACT

A foundation form is pre-fabricated, shipped to job site, placed in a hole, leveled, and concrete is poured into it to form a large surface area footing topped by a pedestal having anchor bolts projecting therefrom to secure a cantilevered arm and mast, such as for traffic lights or railroad signals, and the hole is back-filled without removing the form panels.

20 Claims, 3 Drawing Sheets

LEAVE-IN-PLACE CANTILEVER CONCRETE FOUNDATION FORM

BACKGROUND OF THE INVENTION

I. Field of the Invention

The present invention is directed to forms for concrete pedestals which may be used to mount cantilevered structures. More particularly, the present invention is directed to a pre-fabricated concrete form work for mounting overhead cantilever signal arms, such as railroad cantilevers, whose form work, including plyform panels, is left in place when the foundation hole is back-filled.

II. Description of Related Art

Cantilever arms are commonly used when a traffic signal or the like is placed over the traffic path, such as a roadway, highway, or railroad. Such cantilever arms are typically supported by a mast that is bolted to a concrete pedestal having four large bolts embedded therein which protrude from the top of the pedestal a few inches. The nominally horizontal cantilever arm is fixed to the mast.

The concrete foundation for cantilevers is typically prepared in one of two ways. First, a hole is dug in the ground for receiving a cylindrical pipe, which may be steel or fiberboard. The pipe may be about 36" (91.5 cm) in diameter and several feet or a few meters deep. An auger drills a hole that the pipe is seated in. The pipe is then shored up against the sides of the hole, and if necessary, reinforcing bar is placed inside the pipe, and the mounting bolts are held in the form work with the threaded ends protruding from the top of the form work. Then, the form work is filled with concrete. This type of cantilever foundation is unacceptable in many applications because the columnar foundation rotates in the soil when winds subject the foundation to twisting moments. This deficiency can be overcome only by using a foundation eight to ten feet deep (2.5–3 m), depending upon soil and load conditions. A columnar foundation this deep, however, is very expensive.

Alternatively, and typically, a large hole is dug in which a conventional form work is erected. These form works tend to be cobbled together from whatever material is handy without any standardization of the structure or procedure.

In general, however, the following process is employed. First, a hole substantially larger than the foundation is dug. A base is laid out with reinforcement steel bars and a plurality of upstanding dowels is attached to the mat by welding, tying or the like. Each dowel typically is a three-fourths inch (1.9 cm) diameter steel rod seven feet (2.1 m) in overall height and includes a J-hook on its lower end, which becomes embedded in the base. Typically, about eight dowels are used in each foundation. These dowels provide the physical connection between the lower, or base portion of the foundation, and the upper or pedestal portion of the foundation.

While the base or mat sets, a wooden box that will hold the concrete for the pedestal is constructed outside the hole. Then the requisite network of reinforcing bars is assembled about the dowels, using welds or tie-wires and the like to hold the bars in place, forming a reinforcing cage. When the reinforcing structure is complete, the box is lifted by a crane and set down over the reinforcement bar cage.

Then the box is leveled and squared. When in proper position, the box is braced against the sides of the hole to prevent it from shifting when the concrete is poured. Frequently, this requires shoring up the hole, particularly in sandy or loose soil. In such soil, this step alone can take several days. The step of bracing the box usually requires two to three hours of work and requires two men to be in the hole throughout this period, which is quite dangerous because the holes are normally not fully shored up, creating the possibility that the hole will collapse on the workers. There is no physical connection between the box and the reinforcing cage—they are independent systems.

Anchor bolts are then temporarily fastened to the box. Each anchor bolt is typically a 1½" (4 cm) diameter steel bar about four feet (1.25 m) long with a J-hook in the lower end and a straight, threaded upper end. Four anchor bolts are usually used. They weigh about 70 pounds (32 kg) each. The anchor bolts typically are inserted through holes in a plank, such as a 2"×4" (5×10 cm) that is laid across the top of the box, and a nut is threaded onto the upper end of each anchor bolt so that they hang vertically within the box. The heavy work pieces make construction of a cage on the outdoor job site tedious, difficult, fatiguing and dangerous.

Next, the box is filled with poured concrete, which is allowed to set for several days. Then workers return to the site, climb down into the hole once more, and dismantle the box. Then the hole is filled, or back-filled, and the site is cleaned up, and a mast, typically having a cantilevered arm, is bolted to the anchor bolts. Under good working conditions, it takes a crew of three men about two full days to construct the box, about two days to build the reinforcing bar network or cage, which requires cutting, bending, tying and welding the reinforcement bars together. Typically, it takes about one and one-half weeks of nearly continuous activity by the crew to install one such cantilever arm foundation for a railroad cantilever signal arm. Thus, the typical prior art process is time consuming, expensive, and dangerous.

Therefore, a need exists for a form work for foundations for cantilevers and a method of making such foundations that can be installed more quickly; that is safer to install; that is cheaper to install; that reduces the level of skill required by the installation crew; that does not need to be braced in the hole because the form work is self-supporting; that produces a foundation that is ready to use sooner than the prior art.

SUMMARY OF THE INVENTION

Accordingly, it is a primary object of the present invention to provide a device and method for installing concrete foundations for cantilever arm-type structures more quickly.

It is a further object of the present invention to provide such a device that is safer to use.

It is a further object of the present invention to provide such a device and method that make a concrete foundation cheaper to install.

It is a further object of the present invention to provide a device and method that reduces the level of skill necessary to install a concrete foundation.

It is another object of the present invention to provide a form work for a foundation that does not need to be braced against the sides of the hole it is seated in because it is self-supporting.

It is a further object of the present invention to provide a device that will allow construction of a concrete foundation that is ready to use sooner than such foundations of the prior art.

These and other objects of the present invention are achieved by providing a pre-fabricated form work having a plurality of legs depending from the pedestal-forming portion of the form work. A flat foot is attached to each leg, enabling the form work to stand upright in a leveled hole. A broad-based foundation, or mat, is made of reinforcing bar fixed to the legs intermediate the bottom of the form and the ends of the legs. This mat is typically about seven feet (2.15 m) by seven feet (2.15 m) and two feet (0.6 m) deep. The reinforcing bar that forms the bottom mat is assembled into the mat by the workers at the job site, which a three-man crew accomplishes in about half an hour.

The upper, or pedestal, portion of the form work, in a preferred embodiment, comprises four angle iron edges, one set in each corner of a form having a rectangular or square horizontal cross section. A flat plate is welded to the bottom of each leg, thereby providing a foot for each leg. These feet enable the completed form to stand by itself. Because the feet define one plane, and are perpendicular to the legs, the entire form work is automatically leveled when the feet are set onto a level, horizontal surface. Appropriate reinforcing bar networks are fixed in place within the pedestal portion of the framework forming a cage, including stirrups for retaining the dowels, which terminate in a J-hook in the mat, and for retaining the anchor bolts, which terminate in a J-hook deep within the form work.

The pedestal portion of the form is enclosed in three-quarter inch plyform, plywood or the like secured by banding, which may be steel, nylon or the like. Thus, the box portion of the form is physically attached to the frame of the cage, forming one complete, integral structure with increased rigidity and strength.

After the mat has been assembled on the job site, the entire form work is lowered into a hole and the base or mat is filled with concrete, which is vibrated appropriately. The entire form work is typically about seven feet (2.15 m) tall which ensures that at least the lower portions of the resulting foundation will be below the frost line virtually anywhere in the United States.

After the mat is poured, it is allowed to set up for several minutes and then the top portion or pedestal can be poured. The hole can be back-filled immediately to within about two feet (0.6 m) of the top of the foundation. It is not necessary to remove any portion of the form after the foundation is made. Typically, however, the top two feet of the form work are removed to improve the appearance of the pedestal and the cantilever arm. The top portion of the form work can be removed, the rest of the hole back-filled, and the cantilever arm safely installed about three days after the pedestal has been poured. The combination of the moist earth and the plywood forms pressing against the completed foundation ensures that the concrete will continue to cure properly, which is important in achieving complete strength because concrete may continue curing for up to ten years after it is poured.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 4:
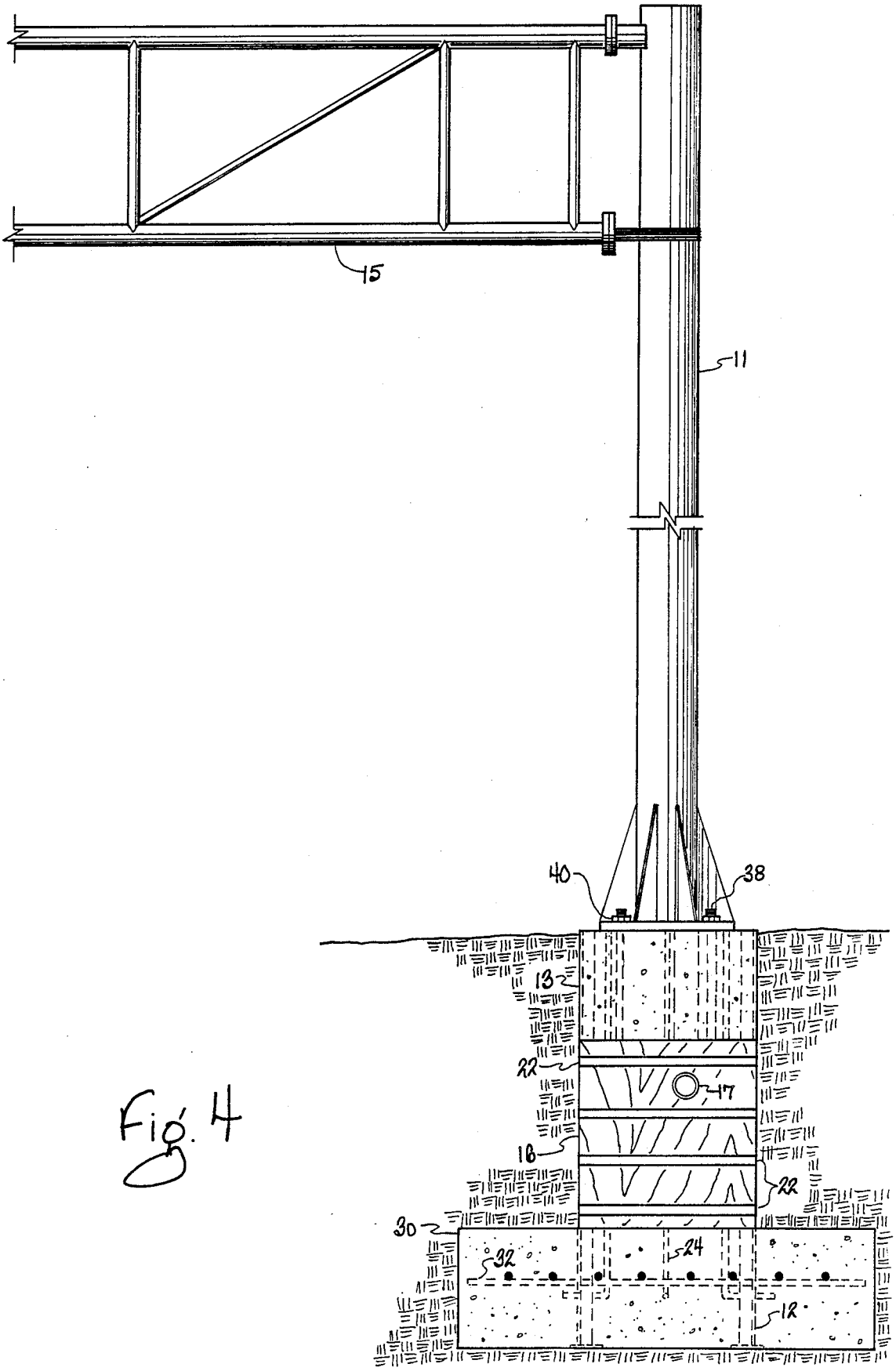
FIG. 4 is a side elevation, partially in section, of the foundation created by the form in use with an attached cantilevered arm.

Referring to FIG. 4, there is shown a side elevation of a foundation utilizing the foundation form and process disclosed herein. The foundation is buried in the ground, which has been cut away in the figure. A vertical mast 11 is attached to the threaded ends of the anchor bolts 38 that protrude from the top surface of the pedestal 13 portion of the foundation by nuts 40. A cantilever arm 15 is attached to the mast 11, permitting traffic signals and the like to be displayed conveniently over the roadway. The lower side wall panels 16 are left in place when the hole is back-filled.

Figure 1:
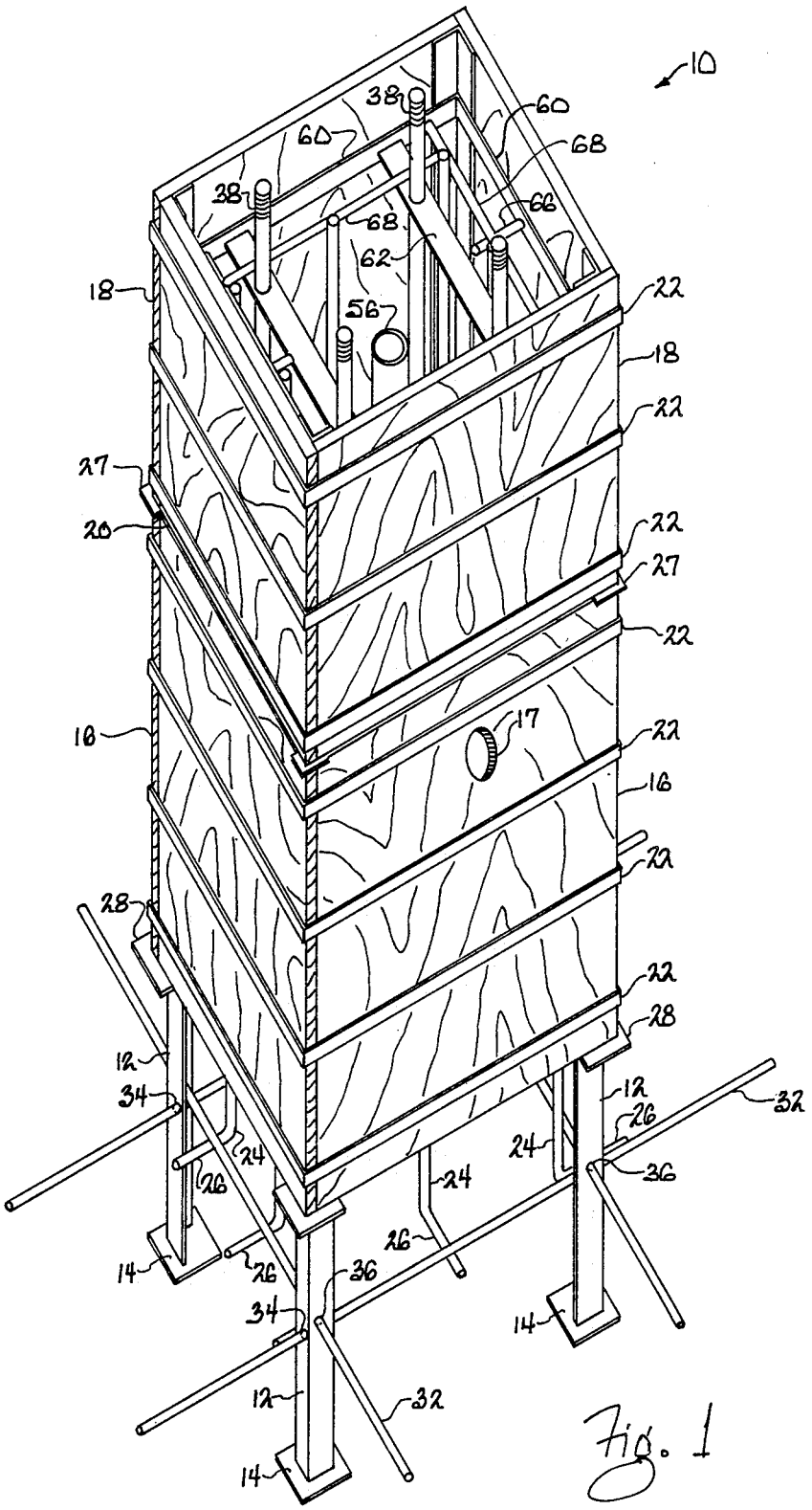
FIG. 1 is an isometric view of a concrete foundation form according to the present invention.

Referring to FIG. 1, there is shown an isometric view of the completed leave-in-place cantilever concrete foundation form, or foundation form 10, ready for installation.

The foundation form 10 comprises four vertical steel angle iron legs 12, or vertical frame members that form the vertical edges of the frame 50. The legs 12 are the same height as the overall foundation form, about seven feet (2.15 m), and extend below the lower side wall 16 panels about two feet (0.6 m). The bottom of each leg terminates in a foot 14, which is welded to each leg 12 and may be, for example 6″×6″ (15 cm×15 cm). The foot 14 is a flat section of sheet metal perpendicular to each leg 12. The feet 14 are carefully leveled to ensure that the foundation form 10 will stand level when placed on a level surface.

The four side walls of the foundation form 10 are formed by plyform panels, such as plywood, and comprise lower side walls 16 and upper side walls 18 joined at the butted seam 20 and bound to the frame 50 of foundation form 10 by the tightened bands 22, which may be steel, nylon webbing or the like, which hold the plyboard panels 16, 18 onto the foundation form 10. The panels 16, 18 are thus attached to the exterior of the box formed by the frame 50. It is intended that the lower side wall panels 16 will be left in place after the concrete is poured to form the foundation, while upper side wall panels 18 will be removed for aesthetic purposes after the concrete has cured for about three days. The entire foundation form 10 is buried in the ground except for the very top.

The portion of the legs 12 that is covered by the lower 16 and upper 18 side wall panels forms the edges of a box, or, together with appropriate reinforcing members discussed below, a frame. In the preferred embodiment, the pedestal 13 has a square plan view, and the mat or base 30 has a larger square plan view. The pedestal is about 3′×3′ (0.9 m×0.9 m).

The foundation form 10 includes one vertically-oriented longitudinal dowel 24 in each corner of the frame 50 and one dowel 24 along the middle of each side, as viewed from the top. The lower end of each dowel 24 terminates in a J-hook 26 at approximately the midpoint of the distance between the feet 14 and the lower edges of lower side walls 16.

The lower side walls 16 rest on the outwardly projecting lower corner flanges 28, which are welded to the legs 12 during construction. The upper side walls 18 rest on the outwardly projecting upper corner flanges 27. These sets of flanges 27, 28, arranged with one outwardly projecting flange in at each corner and with all upper flanges in the same horizontal plane and all lower flanges in the same (lower) horizontal plane simplify assembly of the foundation form 10 by holding the weight of the panels 16, 18 while the bands 22 are tightened and secured.

The lowermost portion of the foundation form 10 includes the mat 30 made of 18–20 straight lengths of reinforcement bar 32 linked together by tie wires to form a mat of bars 32 arranged in a grid of bars 32 in horizontal planes, with about one-half of the bars 32 perpendicular to the other one-half of the bars 32. This mat is the only portion of the foundation form 10 that is assembled at the job site, the rest being entirely pre-fabricated and shipped ready for use. Two men can assemble the mat from pre-cut sections of reinforcement bar 32 in about 30 minutes. The sections of reinforcement bar 32 first mounted are pushed through aligned aperture pairs 34, 36 in the legs 14, forming a rectangular grid to which other reinforcement bars 32 are fastened by tie wires. The reinforcement bars are about six feet (1.8 m) long and are three-fourths of an inch (1.9 cm) in diameter, as is all the reinforcing bar used in the preferred embodiment.

Still referring to FIG. 1, the anchor bolts 38 protrude from the top of the foundation form 10, where they are held in place by nuts 40. The anchor bolts 38 pass through apertures in a form, such as a 2″×4″ (5 cm×10 cm) lumber stud 42, which are secured to the upper side walls 18 by the wood blocks 44 using appropriate fasteners. The nuts 40 are rotated to allow the desired length of the anchor bolt 38 to protrude from the foundation form 10.

Figure 2:
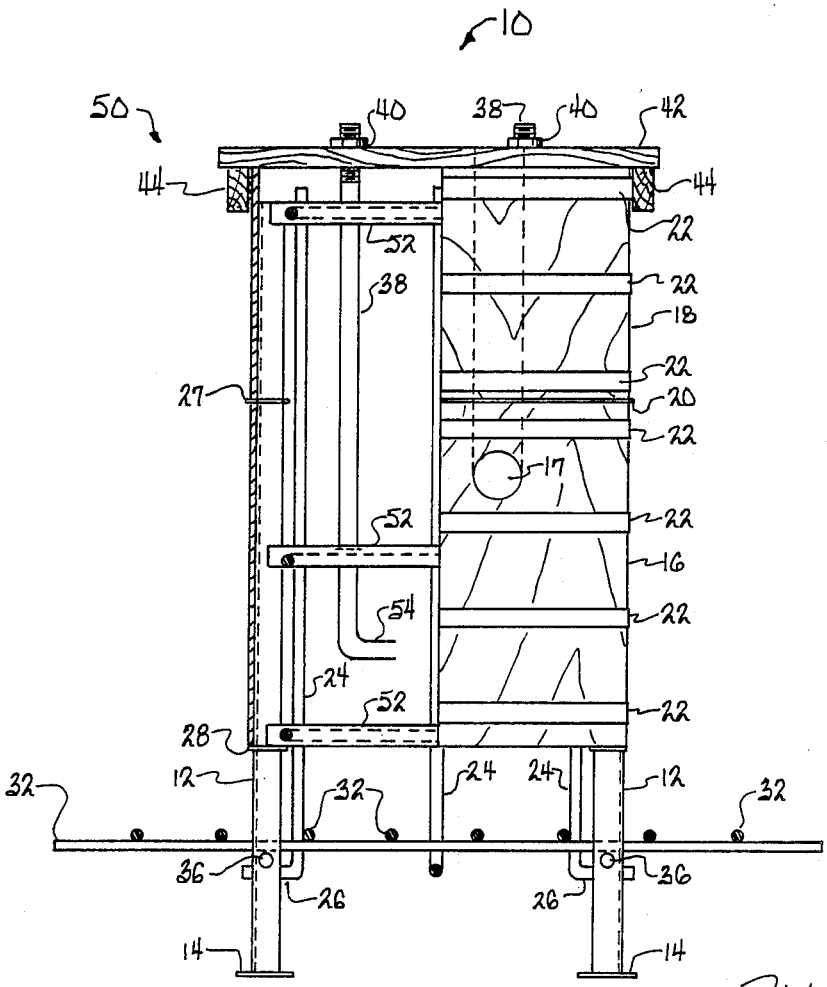
FIG. 2 is a side elevation of the foundation form of FIG. 1 showing the exposed frame on the left side of the form and the side wall panels on the right side of the form.

Referring to FIG. 2, there is shown the frame 50 of the foundation form 10 without the side walls 16 in the left hand half of the drawing, while the right hand side shows the form side walls 16, 18 in place on the frame. The stirrups 52 maintain the anchor bolts 38, which terminate in J-hooks 54, and the dowels 24 in their proper vertical alignment. One panel of side wall 16 includes an opening 17 for introducing the conduit 56, which is preferably three to four inches (7.4–10.8 cm) in diameter, for carrying any necessary electrical or communications signal wires or other conductors. The conduit 56 is held in place by tie wires or other means. Each of the legs 12 is welded at the appropriate juncture to each of the stirrups 52, providing a rigid frame 50 for the foundation form 10.

Figure 3:
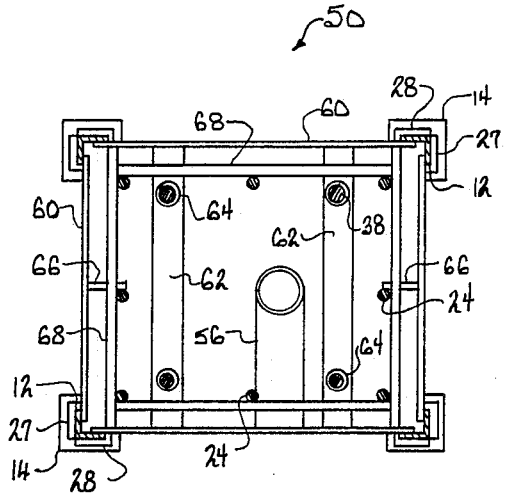
FIG. 3 is a plan view of the form of FIG. 1.

Referring to FIG. 3, there is shown a plan view of the frame 50 of the foundation form 10 without any side wall panels attached, showing the bar steel struts 60 welded to one side of each angle iron leg 12, along the inside surface of each leg 12, thereby forming a box-shaped top. Two reinforcing steel straps 62, oriented parallel to one another, are welded to the struts 60 and include apertures 64, which are penetrated by the anchor bolts 38.

Clearly visible in FIG. 3 are the upper corner flanges 27, for supporting side wall panels 18 during construction. The placement of the dowels 24 is also clearly visible in FIG. 3, comprising one dowel 24 in each corner of the frame 50 and one dowel 24 at the middle of each side. Also included is a pair of lifting lugs 66, which may be short sections of reinforcing bar welded to opposing struts 60 and passed under the additional reinforcing struts 68, which are fastened together in a box-like grid. The portion of the frame 50 which is not the legs, that is, the portion of the frame 50 that is enclosed by the lower side walls 16 and the upper side walls 18, comprises a box having an open top and bottom, and having edges formed by the legs 12.

In use, the foundation form 10 is shipped to the job site, and the crew digs a hole for it. The footing formed by pouring concrete over the mat portion of the form is typically two feet (0.6 m) thick and seven feet (2.15 m) on each side.

To install the foundation form 10, a three-man crew excavates the foundation hole, levels and compacts the bottom. Then the foundation form 10, including the mat 30, is picked up by a backhoe or small boom truck, using lifting lugs 66, and is set into the hole. It takes the crew three to four minutes to level and align the foundation form 10, which is then self-supporting and requires no shoring.

To reduce installation time an accelerator is mixed with the concrete. A good accelerator is one 90-pound (41 kg) bag of calcium chloride per ten cubic (7.6 kl) yards of concrete, which enables the work crew to pour the bottom two feet (0.6 m), which will comprise the base 30, wait several minutes and then pour the top portion or pedestal 13 of the foundation. Concrete with compression strength of 4000 psi (567 kg/cm$^2$) after twenty-eight days of curing is recommended.

As soon as the concrete is poured and vibrated and leveled as required, the foundation hole can be back-filled to the bottom of side wall panels 18. Normally, back-fill must be done in 12 inch lifts, tamping each lift with a hand compactor. In this way, a three-man crew can construct four completed concrete pedestals in a single day.

After allowing the concrete to cure for a minimum of three days, the work crew strips the top two feet of wood comprising side walls 18 from the now completed concrete pedestal, then back-fills and tamps the remainder of the foundation hole. Naturally, the top two bands 22 are cut in this process.

The banding and panels 16 remain in place in the ground. The compacted soil around the pedestal and the wet plywood panel side wall 16 keep the concrete moist, allowing it to continue to cure. Eventually, the side panel 16 will decay and compress, but this will not disturb or loosen the pedestal.

Having thus described the invention, what is claimed as new and desired to be secured by Letters Patent is:

1. A foundation form comprising:

(a) a box; and (b) a plurality of legs attached to said box and depending therefrom, each said leg having a foot attached to it.

2. A foundation form in accordance with claim 1 further comprising a mat of reinforcement bars attached to said depending portion of said legs.

3. A foundation form in accordance with claim 1 wherein said box further comprises a plurality of vertical members, each said vertical member being joined to each adjacent vertical member by at least one strut, with each said strut being fixed at each of its two ends to one said member.

4. A foundation form in accordance with claim 3 wherein each said member comprises an edge of said box.

5. A foundation form in accordance with claim 3 wherein said members extend beyond the edges of said box to form said legs.

6. A foundation form in accordance with claim 2 wherein said box further comprises a plurality of panels attached to the exterior of said box whereby the sides of said box are enclosed by side walls, and means for securing said panels to said box.

7. A foundation form in accordance with claim 6 wherein said securing means further comprises a plurality of outwardly projecting corner flanges fixed to said vertical members and upon which said panels rest, and a plurality of tightened bands on the exterior surfaces of said panels.

8. A foundation form in accordance with claim 6 wherein said box further comprises two sets of said panels, an upper set and a lower set, and said panel sets attached to the exterior of said box whereby the sides of said box are enclosed by upper and lower side walls, and means for securing said panels to said box.

9. A foundation form in accordance with claim 8 wherein said securing means further comprises two sets of outwardly projecting corner flanges, an upper set of said flanges and a lower set of said flanges, each said flange set consisting of a plurality of said flanges, and fixed to said vertical members, and upon which said upper and lower panels, respectively, rest and a plurality of tightened bands on the exterior surfaces of said upper panels and said lower panels.

10. A foundation form in accordance with claim 1 wherein said box further comprises a plurality of horizontal stirrups attached to said vertical members, and a plurality of vertical dowels extending downward through said box into said mat and terminating at their lower ends with a J-hook, and each said dowel penetrating an aperture in at least one said stirrup.

11. A foundation form in accordance with claim 1 wherein said box further comprises a plurality of horizontal stirrups attached to said vertical members, and a plurality of vertical anchor bolts extending downwardly through a portion of said box, each said anchor bolt terminating at its lower end in a J-hook, with the top end of each said anchor bolt being threaded and extending above the top of said box, and means for retaining said anchor bolts in position.

12. A foundation form in accordance with claim 11 wherein said retaining mean further comprises at least one elongated member having a plurality of apertures penetrated by said threaded ends of said anchor bolts, at least one nut threaded on the threaded end of each said anchor bolt, and said elongated member resting on said top edge of at least two of said side walls.

13. A foundation form in accordance with claim 11 further comprising means for maintaining the position of said elongated members relative to said side walls.

14. A foundation form in accordance with claim 1 further comprising a conduit within said box, means for maintaining one end of said conduit at the top of said box, and an aperture in one said panel that the other end of said conduit penetrates.

15. A foundation form comprising:

(a) a box having a frame, said frame comprising plurality of spaced vertical frame members;

(b) a plurality of struts, with each said strut being fixed at each of its two ends to one said member;

(c) a plurality of panels attached to the sides of said box and means for securing said panels to said box frame;

(d) a plurality of legs attached to and depending from said frame;

(e) a plurality of horizontal stirrups attached to said frame;

(f) a plurality of vertically oriented anchor bolts set within said frame and means for maintaining said anchor bolts in position; and (g) a plurality of vertically oriented dowels and means for maintaining said dowels in position.

16. A foundation form in accordance with claim 15 wherein said frame further includes a plurality of outwardly projecting corner flanges.

17. A foundation form in accordance with claim 15 wherein said box further includes two sets of said panels, an upper set and a lower set.

18. A foundation form in accordance with claim 15 wherein said anchor bolts further comprise a threaded portion at the upper end of each said anchor bolt and a J-hook at the lower end of each said anchor bolt.

19. A foundation form in accordance with claim 15 wherein at least one foot is attached to the lower portion of each said leg.

20. A foundation form comprising:

(a) a box having a frame, said frame further comprising four spaced vertical members having integral depending portions extending below said box and forming legs;

(b) a foot attached to the lower portion of each said leg;

(c) a plurality of struts, with each said strut being fixed at each of its ends to one said vertical member;

(d) a plurality of upper side wall panels and means for securing said upper panels to the exterior of said box;

(e) a plurality of lower side wall panels and means for securing said lower panels to the exterior of said box;

(f) a plurality of vertically-oriented anchor bolts within said frame, each said anchor bolt having a threaded portion at the upper end and a J-hook at the lower end and means for maintaining the position of said anchor bolts; and (g) a plurality of vertically-oriented dowels and means for maintaining the position of said dowels.

* * * * *